US007279436B2

(12) United States Patent
Pintz

(10) Patent No.: US 7,279,436 B2
(45) Date of Patent: Oct. 9, 2007

(54) GRID FABRIC

(75) Inventor: Heiko Pintz, Nordhorn (DE)

(73) Assignee: Huesker Synthetic GmbH, Gescher (DE)

( * ) Notice: Subject to any disclaimer, the term of this patent is extended or adjusted under 35 U.S.C. 154(b) by 182 days.

(21) Appl. No.: 10/495,846

(22) PCT Filed: Apr. 19, 2003

(86) PCT No.: PCT/EP03/04110

§ 371 (c)(1),
(2), (4) Date: May 17, 2004

(87) PCT Pub. No.: WO2004/033777

PCT Pub. Date: Apr. 22, 2004

(65) Prior Publication Data

US 2004/0266291 A1 Dec. 30, 2004

(30) Foreign Application Priority Data

Sep. 27, 2002 (DE) ..... 102 45 503

(51) Int. Cl.
*D03D 27/00* (2006.01)

(52) U.S. Cl. ..... 442/43; 442/2; 442/4; 442/46; 442/49; 442/148; 442/164; 442/180; 442/203; 442/208; 442/218; 442/220; 428/85; 428/92; 428/93

(58) Field of Classification Search ..... 428/85, 428/92, 93, 94; 442/2, 49, 43, 4, 46, 148, 442/164, 180, 203, 208, 218, 220
See application file for complete search history.

(56) References Cited

U.S. PATENT DOCUMENTS

| | | | | |
|---|---|---|---|---|
| 3,199,547 | A | 8/1965 | Knutson et al. | |
| 3,921,313 | A * | 11/1975 | Mahide et al. | 36/4 |
| 4,472,086 | A | 9/1984 | Leach | |
| 5,110,656 | A * | 5/1992 | Inaba et al. | 442/5 |
| 5,292,465 | A * | 3/1994 | Kobayashi et al. | 264/45.5 |
| 5,669,838 | A * | 9/1997 | Kennedy et al. | 473/596 |
| 5,707,710 | A * | 1/1998 | Zafiroglu | 428/151 |
| 5,965,467 | A * | 10/1999 | Stevenson et al. | 442/218 |
| 6,056,479 | A | 5/2000 | Stevenson et al. | |
| 6,818,571 | B1 * | 11/2004 | Pintz et al. | 442/2 |

OTHER PUBLICATIONS

Baumgart et al. DE 19560541, Feb. 20, 1997, partial translation.*
Dictionary definition of "bulge" The American Heritage® Dictionary of the English Language, Fourth Edition Copyright © 2004 by Houghton Mifflin Company, no month.*

* cited by examiner

*Primary Examiner*—Andrew Piziali
(74) *Attorney, Agent, or Firm*—Murihead and Saturnelli, LLC

(57) ABSTRACT

A wide-meshed grid fabric, in particular a geogrid, in which warp thread bundles composed of multiple warp threads and weft thread bundles composed of multiple weft threads intersect and surround meshes or lattice openings. To give the grid fabric, which may also be a scrim, a greater volume, whereby, among other things, improved reinforcement of the soil may be achieved, individual threads of a thread bundle in a mesh are longer than other threads of the same thread bundle, the longer threads running in a wave pattern and forming at least one open loop or bulge per mesh; the open loop or bulge may protrude upward and/or downward from the plane of the grid fabric. A plastic coating may stiffen the grid fabric.

13 Claims, 2 Drawing Sheets

GRID FABRIC

BACKGROUND OF INVENTION

1. Technical Field

The present invention relates to a wide-meshed grid fabric in which the clearance of the meshes is delimited by warp thread bundles composed of multiple warp threads and by weft thread bundles composed of multiple weft threads, the warp threads and the weft threads being interwoven at the points of intersection of the warp thread bundles and the weft thread bundles running at right angles to one another.

The rectangular or square lattice openings formed by the warp thread bundle and the weft thread bundle are referred to in this description as "mesh."

2. Description of the Related Art

Grid fabrics of this type which, if they are impregnated or coated with a synthetic polymer, are used in particular for reinforcing bitumen-bonded road surfaces or for reinforcing cement-or gypsum-bonded mortar layers, or as geogrids for reinforcing soils, are known from DE 20 00 937; 3120 661; 3136 026; 4123 055, and 199 62 441.

The warp threads and the weft threads are preferably made of high tensile-strength multifilament synthetic yarns, in particular of aramid fiber, polyester, or the like. Glass filament yarns may also be used.

The warp thread bundles and the weft thread bundles are composed of at least four threads.

The compound which encloses the warp thread bundles, the weft thread bundles, and their points of intersection, thus fixing the grid fabric and protecting it against chemical and mechanical stress, may be, depending on the application, a PVC paste, a latex dispersion, or dispersions of bitumen, acrylics, or similar soft plastics, as well as mixtures thereof.

The term "grid fabric" also relates to scrims in which the warp threads and the weft threads are not interwoven at the points of intersection, but are bonded to one another using other techniques, Raschel technology in particular, or also by gluing or welding. Thus, it is desirable to create a grid fabric in which the grid fabric is provided with a larger volume using weaving technology and, if used as a geogrid, to achieve improved interlocking with the soil to be reinforced.

According to one embodiment of the present invention, individual threads of a bundle of threads are longer per mesh than the mesh clearance and are longer than other threads of the same bundle of threads, the longer threads running in a wave pattern and forming at least one open loop or bulge per mesh.

Due to the fact that one portion of the weft or warp threads within the mesh clearance is longer than a second portion of the weft or warp threads of the same bundle of threads, the longer threads form bulges or open loops per mesh which protrude mostly upward or downward from the plane of the grid fabric.

To prevent the bulges or open loops protruding from the plane of the grid fabric from falling back onto the plane of the grid fabric, the grid fabric is stiffened by impregnation or by coating using a synthetic polymer material.

The different lengths of the warp threads and weft threads per mesh may be obtained by using warp threads and weft threads which shrink or expand differently for example under heat treatment.

In scrims, individual warp threads of a warp thread bundle and/or individual weft threads of a weft thread bundle per mesh may be lifted from the grid plane before the scrim passes the point at which the warp threads and weft threads are bonded by gluing, welding, or by using Raschel technology.

Grid fabrics according to DE 199 62 441 A1 are particularly advantageous for use in geotextiles. In this grid fabric, the warp thread bundles are divided into a first warp thread group and a second warp thread group, the first warp thread group intersecting with the second warp thread group of the same warp thread bundle once per mesh in a half-twist. The first warp thread group is always positioned on top and the second warp thread group always beneath it. At the points of intersection of warp threads and weft threads, the threads are interwoven with one another either individually or in groups.

A higher tensile stress in the warp direction results in the threads of the two warp thread groups of a bundle, which run in a zigzag pattern and intersect with each other once per mesh, moving closer together in the area of the points of intersection which in turn results in the grid fabric being less elastic in the warp direction and being able to absorb greater forces without further expansion, and also in a portion of the weft threads looping around the warp thread groups, which are displaced closer to each other, in an S pattern, while the portion of the weft threads interwoven in the opposite phase passes the point of intersection essentially straight, so that this portion of the weft threads is longer per mesh than the portion of the shorter threads which determines the clearance of the meshes.

The grid fabric according to the present invention having loops protruding from the plane of the lattice is particularly advantageous for numerous applications. Not only is improved interlocking with the soil to be reinforced achieved, but the grid fabric according to the present invention is also advantageous for reinforcing hardening compounds and products, e.g., floor pavements, as well as gypsum and concrete products, or as a supporting web in the manufacture of setting or hardening products made of plastic, gypsum or concrete mortar, which are sprayed or formed onto the supporting web so that the loops protrude into the hardened products which remain connected via the supporting web. Furthermore, the grid mat provided with protruding loops is well suited to form the supporting part of a drainage mat. Parts such as, for example, fascines may be attached to or parts such as, for example, steel reinforcements, or drainage tubes, may be inserted through the loops protruding from the plane of the fabric upward, downward or upward and downward.

Finally, the grid fabric according to the present invention is well suited for erosion protection, as an anti-slip mat, or as a snow brake.

The grid fabric having protruding loops and being surrounded with an elastic plastic layer has very high static friction. As an intermediate layer between stacked stone blocks of a retaining wall, this lattice anchored in the embankment may connect the wall to the embankment.

BRIEF DESCRIPTION OF THE DRAWINGS

Exemplary embodiments of the present invention are explained in greater detail in the following description on the basis of the drawing.

DETAILED DESCRIPTION OF VARIOUS EMBODIMENTS

Figure 1:
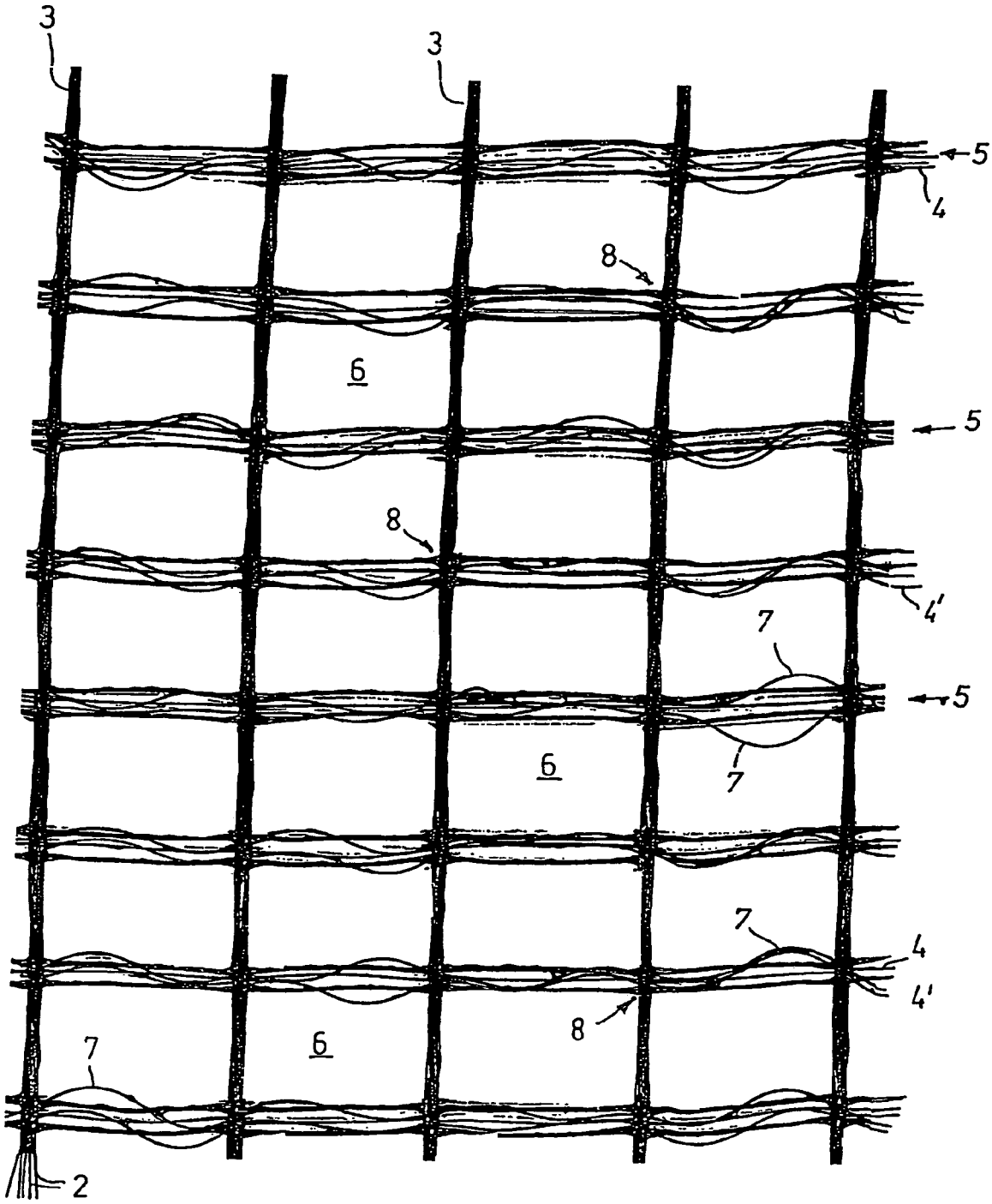
FIG. 1 shows a top view of the grid fabric according to the present invention.
Figure 2:
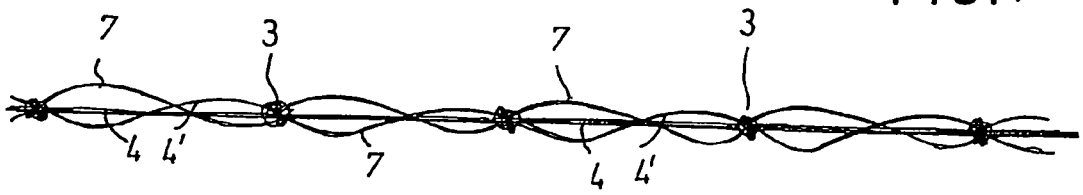
FIG. 2 shows a front view of the grid fabric.

The wide-meshed grid fabric 1 according to FIGS. 1 and 2 is formed of warp thread bundles 3 composed of multiple warp threads 2 and weft thread bundles 5 composed of multiple weft threads 4. Warp thread bundles 3 and weft thread bundles 5 surround rectangular or square lattice openings or meshes 6. A portion 4' of weft threads 4 is longer per mesh 6 than another portion of weft threads 4, so that the longer weft threads form bulges or open loops 7 most of which protrude upward and downward from the plane of grid fabric 1.

Weft threads 4, 4' are, individually or in groups, interwoven at points of intersection 8 with warp threads 2 of the warp thread bundles. Furthermore, grid fabric 1 and its open loops 7 are stiffened by impregnation or by coating using a synthetic polymer material.

Figure 3:
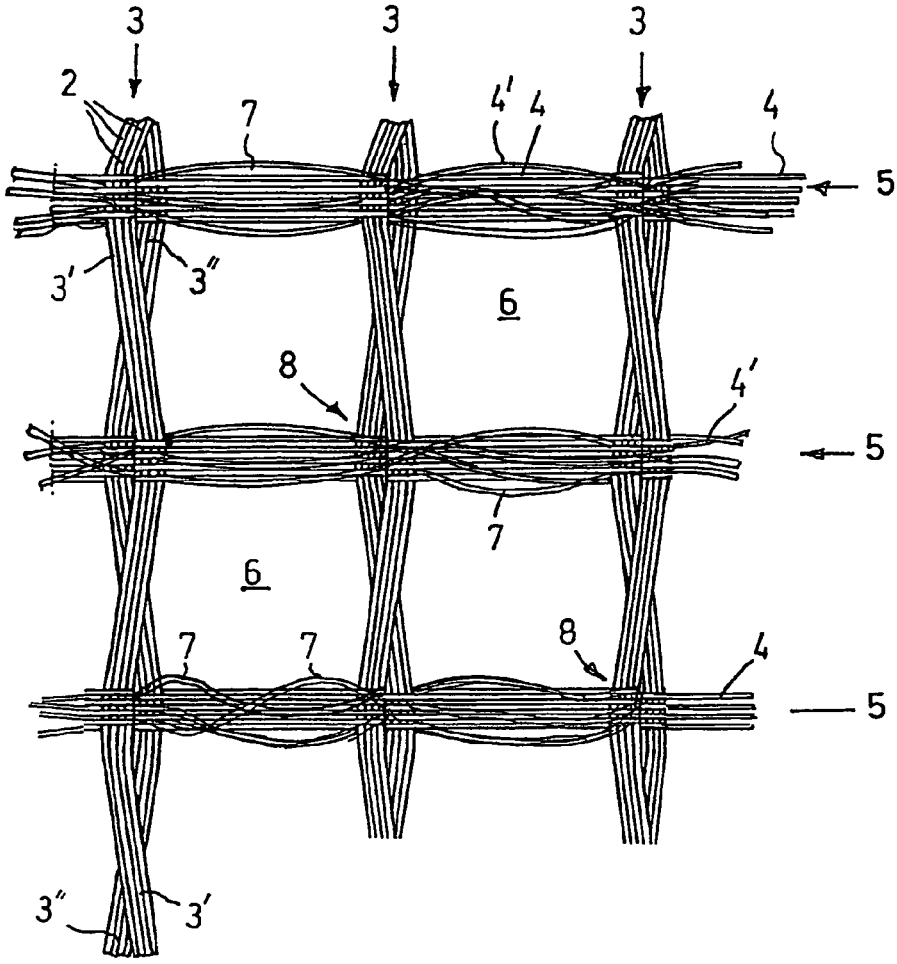
FIG. 3 shows a top view of another exemplary embodiment according to the present invention.
Figure 4:
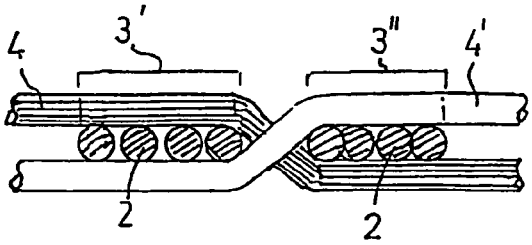
FIG. 4 shows an enlarged sectional view of a point of intersection of a grid fabric.

FIG. 3 shows a large-surface grid fabric 1 in which, for example, the warp thread bundles 3 have eight warp threads 2 and the weft thread bundles have eight weft threads 4, 4'.

Warp thread bundles 3 are divided into a first warp thread group 3' and a second warp thread group 3". These two warp thread groups 3' and 3" are interwoven at points of intersection 8 with weft threads 4 of weft thread bundles 5. Between two weft thread bundles 5, i.e., per mesh 6, one warp thread group 3' crosses the other warp thread group 3" of a warp thread bundle 3 in a half-twist.

Weft threads and warp threads are interwoven at points of intersection 8 in a way that a first portion of weft threads 4 of a weft thread bundle 5 runs over warp threads 2 of first warp thread group 3' and a second portion 4' of weft threads of a weft thread bundle 5 runs beneath warp threads 2 of first warp thread group 3' and over warp threads 2 of second warp thread group 3". Each odd-numbered weft thread runs over first warp thread group 3' and beneath second warp thread group 3", while each even-numbered weft thread runs beneath first warp thread group 3' and then over second warp thread group 3" of warp thread bundle 3.

Figure 5:
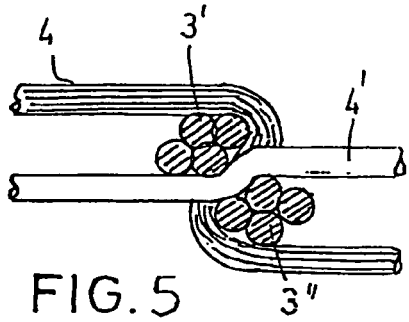
FIG. 5 shows an enlarged sectional view of a point of intersection of the grid fabric according to FIG. 3.

Due to high tensile force applied to warp thread bundles 3, the warp thread groups 3'and 3", which run in a zigzag pattern, stretch, so that a portion of the weft threads, as shown in FIG. 5, loops around the warp thread groups in an S pattern at points of intersection 8, while another portion of the weft threads passes points of intersection 8 with less loss in length.

As shown in FIG. 5, warp thread groups 3'and 3", which run in a zigzag pattern, move closer together at points of intersection 8 when tensile force is applied to warp thread bundles 3. The inner edges of warp thread groups 3'and 3" overlap slightly, so that a portion of the weft threads must cover a longer distance at points of intersection 8 than the other portion of weft thread bundle 5.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A grid fabric, comprising:

warp thread bundles composed of multiple warp threads and weft thread bundles composed of multiple weft threads that intersect and surround meshes or lattice openings, wherein individual threads of a thread bundle in a mesh are longer than other threads of the same thread bundle, the longer threads running in a wave pattern and forming at least one open loop per mesh, the loop being stiffened by at least one of: impregnation and coating using a synthetic polymer material and the loop protruding in at least one of a direction upward and a direction downward from a lattice plane of the grid fabric, wherein the threads of the weft thread bundles are interwoven with the threads of the warp thread bundles at points of intersection and wherein the warp thread bundles are divided into a first warp thread group and a second warp thread group, the first warp thread group intersecting the second warp thread group of the same warp thread bundle per mesh on top in a half-twist, and the warp threads of both warp thread groups are interwoven with the weft threads at the points of intersection.

2. The grid fabric as recited in claim 1, wherein the grid fabric including the loops protruding from the lattice plane are stiffened by encasing using a synthetic polymer material.

3. The grid fabric as recited in claim 1, wherein the threads of the weft thread bundle form the longer threads per mesh.

4. The grid fabric as recited in claim 1, wherein the longer threads per mesh are longer by 15% to 25% than the other threads of the same thread bundle.

5. The grid fabric as recited in claim 1, wherein the warp thread group is interwoven with the weft threads in such a way that at all points of intersection a first portion of the weft threads of a weft thread bundle runs over the warp threads of the first warp thread group and beneath the warp threads of the second warp thread group of a warp thread bundle and a second portion of the weft threads of weft thread bundle runs beneath the warp threads of the first warp thread group and over the warp threads of the second warp thread group of the warp thread bundle.

6. The grid fabric as recited in claim 5, wherein each odd-numbered weft thread of a weft thread bundle belongs to the first portion and each even-numbered weft thread belongs to the second portion of weft threads of a weft thread bundle.

7. The grid fabric as recited in claim 1, wherein most of the loop protrudes in at least one of the direction upward and the direction downward.

8. A grid fabric, comprising:

at least one warp thread bundle including a plurality of warp threads; and at least one weft thread bundle including a plurality of weft threads, wherein at least one individual thread of at least one of said thread bundles is a longer thread that is longer than at least one other thread of at least one of said thread bundles, the at least one longer thread running in a wave pattern and forming at least one stiffened open loop protruding out of a lattice plane of the grid fabric, wherein the plurality of warp threads are divided into a first thread group and a second thread group and are interwoven with the plurality of weft threads, and wherein at points of intersection a first portion of the weft threads of the at least one weft thread bundle runs over warp threads of the first warp thread group and beneath warp threads of the second warp thread group and a second portion of the weft threads of the at least one weft thread bundle runs beneath the warp threads of the first warp thread group and over the warp threads of the second warp thread group.

9. The grid fabric as recited in claim 8, wherein the at least one longer thread is longer by 15% to 25% than the at least one other thread.

10. The grid fabric as recited in claim 8, wherein the weft threads are numbered sequentially and wherein each odd-numbered weft thread of the at least one weft thread bundle belongs to the first portion and each even-numbered weft thread belongs to the second portion.

11. The grid fabric as recited in claim 8, wherein the at least one stiffened open loop is impregnated or coated with a synthetic polymer material.

12. The grid fabric as recited in claim 11, wherein said synthetic polymer material is one of a PVC paste or a latex dispersion.

13. The grid fabric as recited in claim 8, wherein most of the at least one stiffened open loop protrudes out of the lattice plane.

* * * * *